US005437609A

United States Patent [19]

Leonard et al.

[11] Patent Number: 5,437,609

[45] Date of Patent: Aug. 1, 1995

[54] CHIROPRACTIC ARTICULATING TRACTION CHAIR

[76] Inventors: David K. Leonard, 27 Holland Dr., Castle Hayne, N.C. 28429; John B. Bland, 4903 Oleander, Wilmington, N.C. 28403

[21] Appl. No.: 122,151

[22] Filed: Sep. 17, 1993

[51] Int. Cl.[6] ..... A61H 1/02

[52] U.S. Cl. ..... 601/91; 606/241; 606/242; 601/98; 297/411.1; 297/313

[58] Field of Search ..... 601/24, 26, 97, 98, 601/100, 101, 89-92; 606/237, 241-245; 297/411.1, 486, 330, 313

[56] References Cited

U.S. PATENT DOCUMENTS

| | | | |
|---|---|---|---|
| 2,572,040 | 10/1951 | Labbe | 601/100 |
| 4,688,557 | 8/1987 | Bradstreet | 128/71 |
| 4,696,512 | 9/1987 | Burnett et al. | 297/68 |
| 4,696,515 | 9/1987 | Heeach | 297/374 |
| 4,860,733 | 8/1989 | Parker, Jr. | 128/25 |
| 5,171,317 | 12/1992 | Corcoran | 606/241 |
| 5,217,488 | 6/1993 | Wu | 606/243 |
| 5,258,019 | 11/1993 | Riddle | 601/24 |
| 5,265,689 | 11/1993 | Kauffmann | 297/330 |

*Primary Examiner*—Robert A. Hafer
*Assistant Examiner*—David J. Kenealy
*Attorney, Agent, or Firm*—Rhodes, Coats & Bennett

[57] ABSTRACT

A mechanized traction chair is disclosed that employs a motor operated underarm support device that in combination with a restrictive seat belt provides forced traction to the upper torso. A lower seating assembly provides a variable articulating motion to the lower torso.

7 Claims, 4 Drawing Sheets

CHIROPRACTIC ARTICULATING TRACTION CHAIR

BACKGROUND—FIELD OF INVENTION AND BRIEF HISTORY

The present invention relates to a recliner type chair that is equipped with a traction apparatus and an articulating lower section that enables a user to position himself/herself in the chair and receive passive therapeutic exercise.

Standard mitigation therapy for back pain formerly consisted of diagnosis and treatment by a qualified orthopedic physician. Therapy most often consisted of exercise, rest, medication, and lastly, surgery. One particular method that was and still is effective for providing relief (especially for lumbar-sacral pain) and one that is routinely employed by hospitals is to place the patient in traction. Traction is accomplished by confining the patient to an orthopedic type bed where the lower torso is elevated and a weighted device is attached to the feet. This effectively stretches the musculature and connective tissue associated with the spine and lower back region. This stretching relieves the pressure on the intervertebral discs, which in turn relieves the pressure on the spinal nerves and patient pain is mitigated.

In recent years the treatment of back pain by chiropractic physicians has proven successful. Chiropractic techniques are non-surgical therapies that involve physical manipulation of muscles, joints and spine. Recent studies have shown that recuperation time from back pain and injury can be significantly reduced when physical manipulation of the injured areas and low impact exercises are employed.

The present invention was conceived with the intent of combining the best methods of orthopedic therapy and chiropractic therapy and present them in one apparatus that would deliver the desired results of pain and injury mitigation in an economical and practicable fashion. Traction was chosen from the orthopedic therapies and articulation of the lower torso is the constituent adapted from chiropractic techniques.

BACKGROUND—DESCRIPTION OF PRIOR ART

There are several types of traction, extension and exercising devices that have been developed and are is use in health clubs, hospitals, and private care. However, these devices are A) too cumbersome to be used in the private home, B) uncomfortable and provide no therapeutic value, C) complex in design and cost prohibitive, D) are not aesthetically or ergonomically designed. U.S. Pat. No. 4,688,575, Bradstreet (1989) shows an example of a traction chair that unlike the present invention requires the use of a person's own body weight to provide the traction mechanism. This prior art also does not provide for any articulation of the lower torso. U.S. Pat. No. 4,860,733, Parker (1989) discloses a reclining chair that moves the upper torso in an oscillating motion but employs no traction apparatus. U.S. Pat. No. 4,696,512, Burnett, et al, (1987) shows a motorized recliner chair that provides relaxation but no therapeutic or traction mechanism. U.S Pat. No. 4,962,963, (1990) describes a power linear reclining seat that again, has no therapeutic value. U.S. Pat. No. 3,999,539, (1978) discloses a water filled orthopedic chair. This art does provide therapeutic value but is generally for examination and diagnosis and is not specific for lower back pain mitigation.

Further disadvantages of the prior art and the advantages and benefits of the present invention will be revealed in the following discussions and drawings.

OBJECTS AND ADVANTAGES OF PRESENT INVENTION

1) The present invention discloses a therapeutic chair that can be manufactured inexpensively and can be used in the comfort and privacy of the home.

2) The present art will be designed both ergonomically and aesthetically. It can be made of lightweight alloy framing and will not be cumbersome. It can be manufactured to coordinate with other furniture in a private home and will not be an embarrassment to display.

3) The present invention will be extremely easy to operate and will not require sophisticated controls or auxiliary equipment to operate it.

4) The present invention will be specifically designed to mitigate lower back pain, especially in the lumbar-sacral region.

5) The present art will not only serve to relieve back pain but can be used concurrently as a means of relaxation. For example, a user can receive therapeutic treatment from the articulating chair while he/she is watching television.

6) The invention will incorporate a computerized control console that will be designed user friendly. A user can begin his/her therapeutic relaxation by merely programming in the desired traction tension and duration of the exercise.

7) The present art will be designed with safety features such as a lock/key on-off switch and an emergency all-stop actuator.

Further objects and advantages of my invention will become apparent from a consideration of the drawings and ensuing description of it.

SUMMARY, RAMIFICATIONS AND SCOPE

As revealed in the previous discussions of prior art. There exists a need for a recliner type chair that effectively mitigates lower back pain by the engineered combination of forced traction and passive articulation. The present art will be designed to facilitate ease of operation and will be aesthetically built. The articulating chair can be manufactured with relatively low-cost since there are no expensive or hi-tech components. This will allow for individual use in the private home. The present invention will be extremely easy to operate and has a built-in auto stop feature in case of emergencies. The articulating traction chair can be locked with a key to prevent unauthorized use. This invention will be specifically designed to mitigate pain in the lumbar-sacral region of the back and will be extremely successful based upon standard traction therapies and physical therapies that have already proven to be very effective.

Therefore an object of the present invention is to combine the principles of chiropractic articulation of the lower torso with the orthopedic method of traction for the upper torso and employ them both in one apparatus to mitigate back pain. Another object of the present art is to use the aforementioned principles and methods and combine them with the comfortability of a recliner type chair. It is also an intention of the invention to provide an economical method for back pain mitigation in the private home. Still another object of the present art is to provide a safe, aesthetically, and ergonomically designed apparatus that can be utilized for relaxation (i.e. furniture) when not being used as therapeutic.

BRIEF DESCRIPTION OF DRAWINGS

While the following disclosure is made with reference to an articulating traction recliner chair, this is for purposes of illustration only. It is to be understood that the features embodied in the present invention may be useful in application differing than those shown and no intent to limit the invention by way of this disclosure is therefore expressed.

Figure 1:
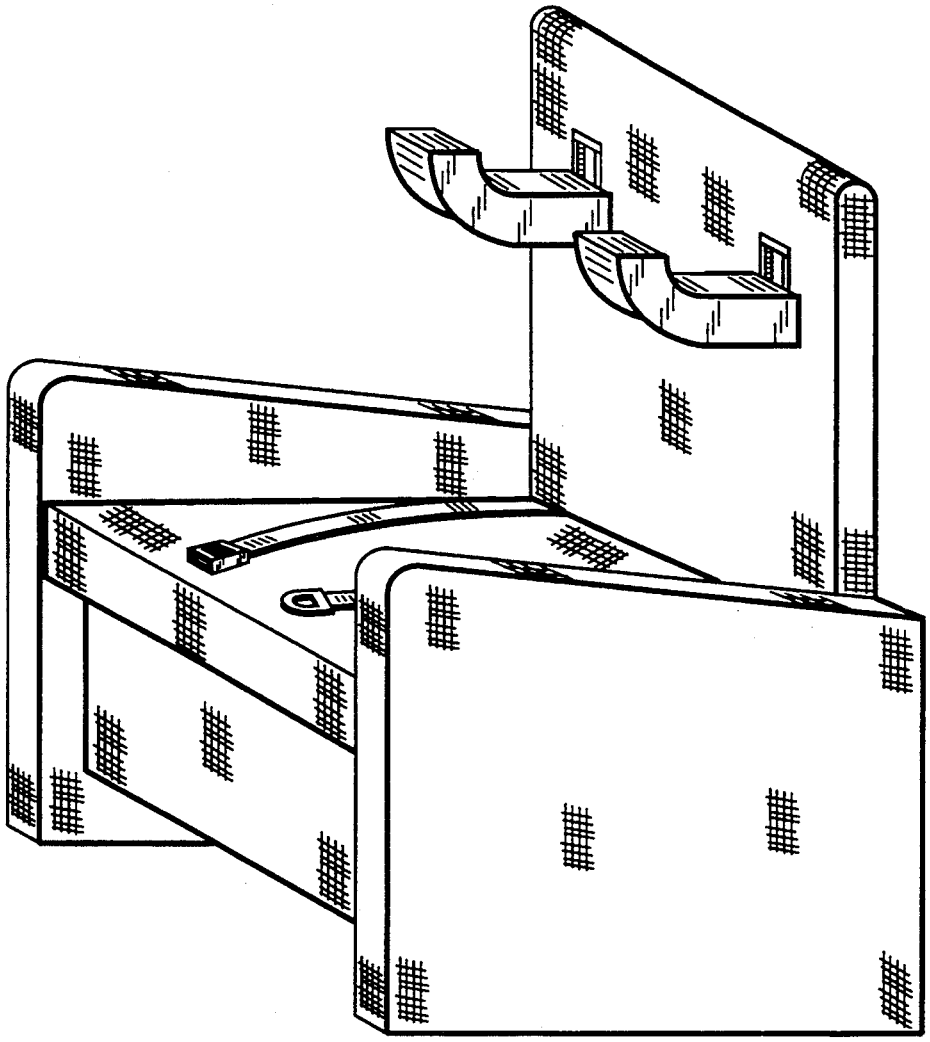
FIG. 1—is a perspective illustration of a chair constructed to the architecture of the present invention.

| Reference Numerals in Drawings | |
|---|---|
| 2 | underarm support assembly |
| 3 | padded back support rest |
| 4 | lower seating assembly |
| 5 | hinge |
| 6 | padded arm rests |
| 7 | lower base frame |
| 8 | gear reduction assembly |
| 9 | rod and crankshaft assembly |
| 9a | crankshaft |
| 9b | rod |
| 10 | restrictive seat belt |
| 11 | acme threaded rod assembly |
| 12 | 1st electric motor |
| 13 | 2nd electric motor |
| 14 | worm gear assembly |
| 15 | upper metal frame |
| 16 | the chiropractic articulating traction chair |
| 17A | the upper bearing |
| 17b | lower bearing |
| 18 | crankshaft end-bearing |
| 19 | computerized control center |
| 20 | emergency stop actuator |

DETAILED DESCRIPTION OF THE PREFERRED EMBODIMENT

Figure 2:
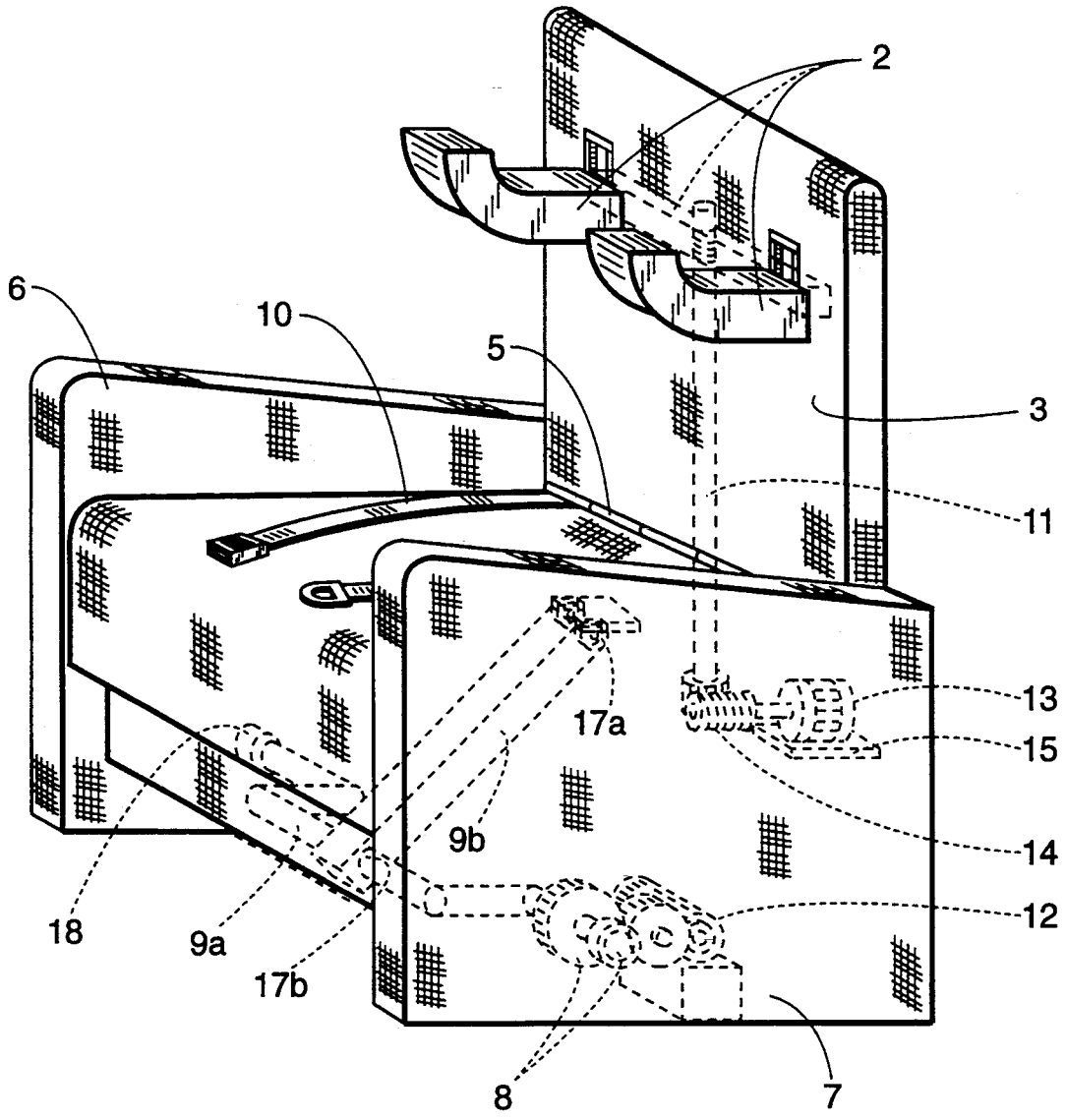
FIG. 2—is a 3-dimensional view of the chair showing internal working mechanisms and specific nomenclature.
Figure 3:
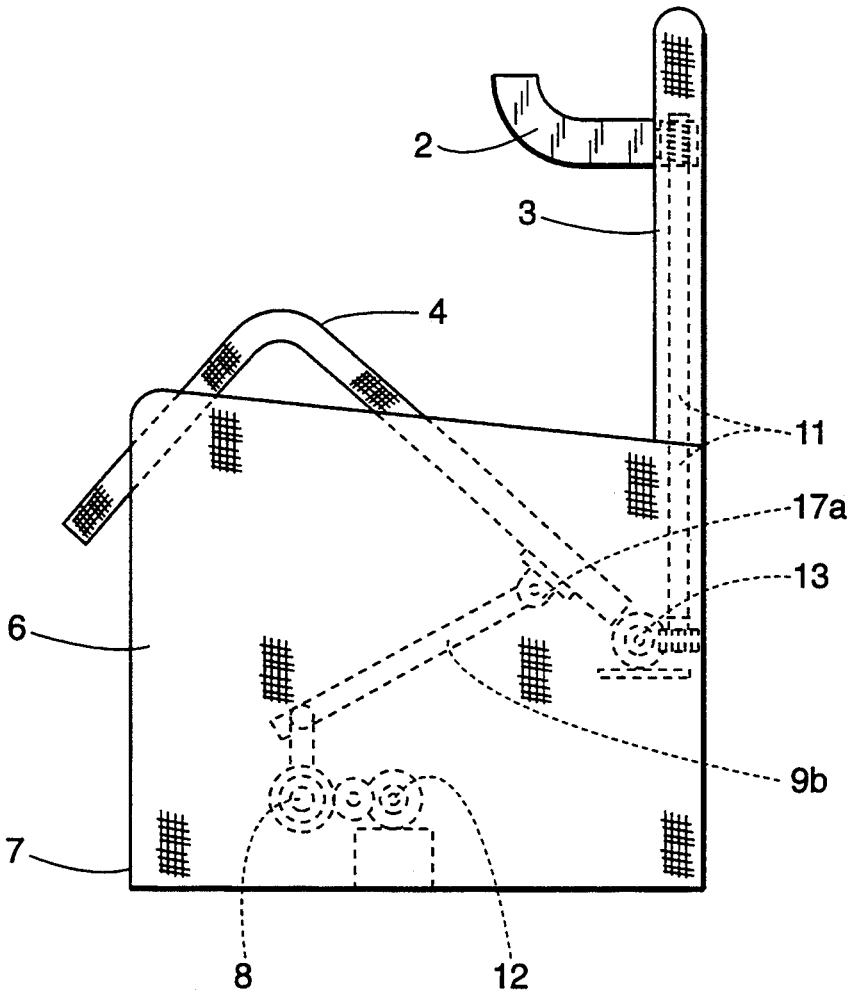
FIG. 3—is a side view of the chair revealing the lower seating assembly in the fully raised position.

FIGS. 1 to 3

Referring to FIG. 1, reference 16 shows an articulating chair that incorporates the general embodiments of the present invention. Articulating chair 16 comprises a lower base frame 7, and shows the hinged lower seating assembly 4 that is mounted on the upper metal frame 15. The underarm support assembly 2 is mounted to the padded back support rest 3. A hinge 5 connects the padded back support rest 3 to the lower seating assembly 4. The padded arm rests 6 join the lower base frame 7 with the upper metal frame 15.

As illustrated in FIG. 2 the internal working mechanisms of the articulating traction chair are shown. An electric motor 12 is mounted on the base frame 7. The 1st electric motor 12 connects to a gear reduction assembly 8 which in turn is welded onto a rod and crankshaft assembly 9. The crankshaft **9*b* is typically constructed out of steel in bar stock form, while the rod 9*a* is made of steel from a square stock. No 17*a* and 17*b* show a set of bearings that are assembled on the rod to reduce friction during articulation of the lower seating assembly 4. The upper rod bearing 17*a* is welded to a metal frame on the underside of the lower seating assembly 4. The lower rod bearing 17*b* is pressed into a machined opening in the rod 9. The left end of the crankshaft 9*a* is held in place by insertion into the crankshaft end-bearing 18. The crankshaft end-bearing 18 is typically welded into position on the lower base frame 7**.

A second smaller electric motor is shown 13 that connects to a worm gear assembly 14. The acme threaded rod 11 is mounted vertically up through the center of the padded back support rest 3. Both the gear on the smaller electric motor 13 and the gear on the acme threaded rod assembly 11 are fastened with the use of a pressed keyway.

At the top of the padded back support rest 3 the acme threaded rod 11 screws directly into a metal bar of the underarm support assembly 2. The metal bar is designed of lightweight alloy material and is machined to accommodate the insertion of the acme threaded rod 11. This entire assembly is machined at very close tolerances to facilitate smoothness and quietness of movement. The exterior visible part of the underarm support assembly 2 as shown in FIG. 3 is constructed of a polished hardwood. FIG. 3 also shows the lower seating assembly 4 in a raised view.

OPERATIONS—FIGS. 1 to 4

A user is seated in the articulating chair just as he/she would sit in a recliner chair. After securing the restrictive seat belt in place around his/her waist the user would place their arms overtop the underarm support assembly. The user would then place his/her spine in traction by activation of the 2nd electric motor 13. This motor would provide a slow controlled upward locomotion to the under arm support assembly 2 which in turn would begin to stretch the user's upper torso by virtue of the user's waist being secured by the restrictive seat belt 10. This is a non-continuous movement and the degree of traction is controlled by the user so as not to place excessive strain on the back. Once a satisfactory degree of traction is achieved, activation of the lower seating assembly can commence. The various operations of the chair would be activated by use of the computer control console 19 located on the top of the padded arm rests 6.

Figure 4:
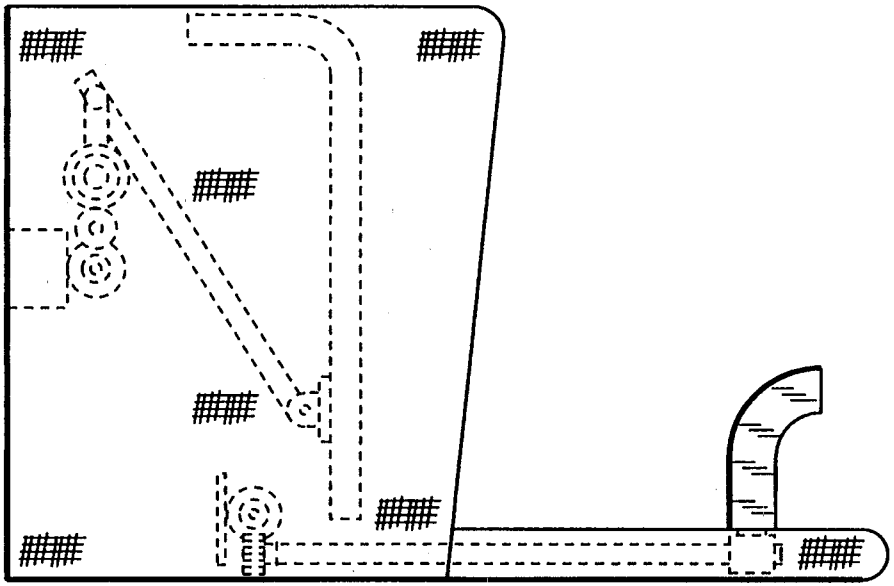
FIG. 4—is a side view of the chair revealing the lower seating assembly in the fully lowered position.

FIGS. 3 and 4 reveal the lower seating assembly in the fully raised and the fully lowered positions respectively. Upon activation of the 1st electric motor 12, the rod and crankshaft assembly 8 will force against the lower seating assembly 4 and begin to move it up and down in an angular motion. This action causes the lower seating assembly to articulate in a continuous up and down motion so as to raise and lower the lower torso of a user. This motion would be variable and determined by whatever program or instructions were entered into the computer console control 19. This articulating motion would be concurrent with the upper torso being in a state of traction via the underarm support assembly 2.

This controlled passive exercise movement can continue for whatever duration the user desires. If an immediate cessation of the articulating chair is desired the user would press the emergency all stop actuator 20. When not is use the entire computerized control console 19 can be locked with a key to avoid unauthorized use.

What is claimed is:

1. An articulating traction chair adapted to raise and lower the lower torso of a user while the user's upper torso is in a state of traction comprising:

(a) a backrest;

(b) an articulating seating assembly movable between a raised position and a lowered position;

(c) a hinge attaching said seating assembly to said backrest;

(d) a vertically adjustable, underarm support assembly projecting from said backrest above said seating assembly;

(e) a seat belt attached to said chair to secure a user in said chair;

(f) means attached to said underarm support assembly for vertically adjusting said underarm support assembly between raised and lowered positions; and (g) means attached to said seating assembly for continuously articulating said seating assembly at said hinge between horizontal and raised positions while said underarm support assembly is in a raised position.

2. The chair of claim 1, further including padded arm rests on either side of said seating assembly.

3. The chair of claim 1, wherein said seat assembly is movable between one-half the vertical and horizontal.

4. The chair of claim 1, wherein said backrest is padded.

5. The chair of claim 1, further including an emergency stop actuator.

6. An articulating traction chair adapted to raise and lower the lower torso of a user while the user's upper torso is in a state of traction comprising:

(a) an generally vertical backrest;

(b) an articulating seating assembly movable between a horizontal position and a half-vertical position;

(c) a hinge attaching said seating assembly to said backrest:

(d) a vertically adjustable, underarm support assembly projecting from said backrest above said seating assembly;

(e) a motorized control means attached to said underarm support assembly for vertically adjusting said underarm support assembly to a raised position; and (f) a motorized control means attached to said seating assembly for continuously articulating said seating assembly between said horizontal position and said half-vertical position when the user's upper torso is in a state of tension and said underarm support assembly is in a raised position.

7. The chair of claim 6, wherein said underarm support assembly is comprised to a pair of spaced supports adapted to fit beneath a user's arms.

* * * * *